United States Patent [19]

Kim et al.

[11] Patent Number: 4,868,942

[45] Date of Patent: Sep. 26, 1989

[54] MEASURING ENVELOPE OPENER DEVICE HAVING A STAMP DISPENSER

[76] Inventors: Yun S. Kim; Mee S. Kim, both of 5702 Oak Stake Ct., Burke, Va. 22015

[21] Appl. No.: 311,849

[22] Filed: Feb. 17, 1989

[51] Int. Cl.[4] ..... B26B 11/00

[52] U.S. Cl. ..... 7/164; 7/170; D8/104; D19/67

[58] Field of Search ..... 7/163, 164, 169, 170; D8/104, 105; D19/65-67

[56] References Cited

U.S. PATENT DOCUMENTS

| | | | |
|---|---|---|---|
| D. 45,599 | 4/1914 | McAdams | D8/102 |
| 165,656 | 1/1952 | Lathrop | D165/656 |
| D. 172,945 | 9/1954 | Baker | D8/104 X |
| D. 179,223 | 11/1956 | Schwartz | D8/104 |
| D. 217,313 | 4/1970 | Dowit | D8/104 |
| 233,161 | 10/1880 | Muckle . | |
| D. 235,091 | 5/1975 | Daenen | D8/104 |
| 293,338 | 12/1987 | Evenson | D19/67 |
| 294,955 | 3/1988 | Ragnerstam | D19/67 |
| 423,351 | 3/1890 | Streeter . | |
| 1,215,010 | 2/1917 | Erikson . | |
| 2,610,399 | 9/1952 | Adams et al. . | |
| 2,750,668 | 6/1956 | Tarrazi . | |
| 4,081,907 | 4/1978 | Bosshold | 30/294 |
| 4,475,652 | 10/1984 | Heard | 206/409 |
| 4,586,671 | 5/1986 | Piana et al. | 242/55.53 |

*Primary Examiner*—James G. Smith

*Attorney, Agent, or Firm*—Birch, Stewart, Kolasch & Birch

[57] ABSTRACT

A measuring letter opener having a stamp dispenser which includes a measuring blade with measurement demarkations along both edges thereof and an aperture in the vicinity of a pointed end thereof, and an animal configurated handle containing a stamp dispensing member disposed therein at the other end of the measuring blade, whereby, after inserting a roll of stamps into the stamp dispensing member and grasping the rugged surface of the animal configurated handle, the user can readily open a letter and conveniently use the stamps dispensed from the stamp dispensing member.

3 Claims, 1 Drawing Sheet

MEASURING ENVELOPE OPENER DEVICE HAVING A STAMP DISPENSER

BACKGROUND OF THE INVENTION

1. Field of the Invention

The present invention relates to a measuring envelope opener having a stamp dispenser and more particularly to an improved envelope opener and stamp dispenser assembly which is especially useful for letter envelopes. The present invention also relates to an improvement in envelope openers, which comprises an opener made from a single strip of metal or plastic, which includes both measured and sharpened blades along both edges at one end, and a animal configurated handle at the other end for packing and dispensing a roll of stamps and for efficiently grasping the handle along its rugged portions.

2. Description of the Prior Art

Previously, several types of envelope openers and stamp dispensers have been separately developed. Such envelope openers are shown in U.S. Pat. No. 233,161 to Muckle, U.S. Pat. No. 423,351 to Streeter, U.S. Pat. No. 1,215,010 to Erikson, U.S. Pat. No. 2,610,399, U.S. Pat. No. 2,750,668 to Tarrazi, and U.S. Pat. No. 4,081,907. Such stamp dispensers are shown in U.S. Pat. No. 4,475,652 to Heard, U.S. Pat. No. 4,586,671 to Piana et al, U.S. Pat. No. Des. 165,656 to Lothrop, U.S. Pat. No. Des. 294,955 to Ragnerstam, and U.S. Pat. No. Des. 293,338 to Evenson. However, these envelope openers and stamp dispensers suffer from a number of difficulties since separate envelope openers and stamp dispensers require separate purchases which are expensive, and these items occupy a large amount of space in a brief case or on the desk. Further, the unavailability of an envelope opener and stamps is frequently experienced when traveling.

SUMMARY OF THE INVENTION

Accordingly, it is an object of the present invention to provide a combined envelope opener and stamp dispenser assembly.

Another object of the present invention is to provide a measuring envelope opener having a stamp dispenser, which includes a measured and sharpened blades along both edges and an aperture in the vicinity of a pointed end thereof at one end, and an animal configurated handle containing means for stamp dispensing therein at the other end.

A further object of the present invention is to provide an improved stationery assembly which is simple in construction, relatively easy to operate, and relatively inexpensive to manufacture.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a measuring letter opener having a stamp dispenser which comprises an envelope opener body including a measuring blade having measurement demarkations along both edges thereof and an aperture in the vicinity of a pointed end thereof, and an animal configurated handle including a stamp packing and dispensing member disposed therein at the other end of the measuring blade, whereby, after inserting a roll of stamps into the stamp dispensing member and grasping the rugged surface of the animal configurated handle, the user can readily open a letter and can conveniently use the stamps dispensed from the stamp dispensing member.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
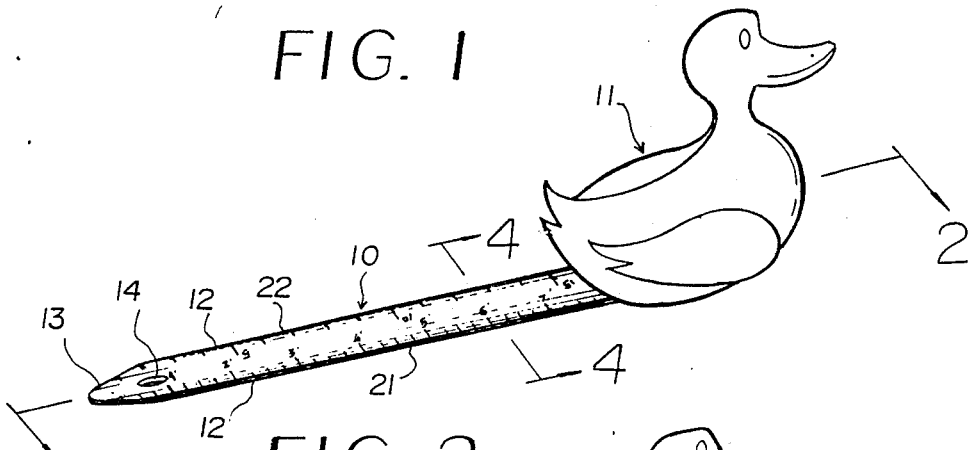
FIG. 1 is a perspective view of a measuring envelope opener having a stamp dispenser according to the present invention.
Figure 2:
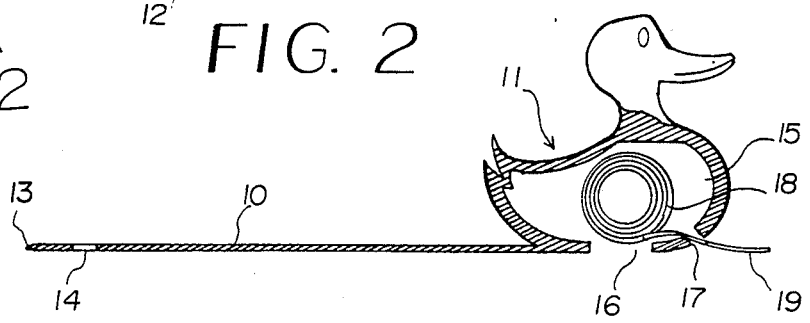
FIG. 2 is a sectional view of FIG. 2, taken along line 2—2.
Figure 4:
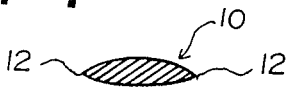
FIG. 4 is a cross-sectional view of FIG. 2 taken along line 4—4.

Referring now in detail to the drawings for the purpose of illustrating preferred embodiments of the present invention, the measuring envelope opener having a stamp dispenser as shown in FIGS. 1, 2, and 4 comprises an envelope opener body 10 at one end and a handle member 11 at the other end thereof.

The envelope opener body lo includes a pointed end 13 for being easily inserted into a sealed envelope to be open, an aperture 14 in the vicinity of the pointed end 13, a measuring blade with measurement demarkations disposed along front and rear edges 12 thereof for being used to continuously cut a sealed envelope and easily measure something as with a measuring ruler. The front edge 12 is provided with a inch measuring scale 21 wherein the measurement demarkations are in inches. The rear edge 12 of the envelope opener body 10 is provided with a centimeter measuring scale 22 wherein the measurement demarkations are in centimeters (FIG. 1).

The handle member 11 has an animal configuration such as a bird or a mammal for being efficiently grasped by the hand so as to cut a sealed envelope and to insert a roll of stamps 18 thereinto or dispense each stamp 19, one by one, from the handle member 11. As shown in the FIG. 2, the handle member 11 contains a hollow storage compartment 15 for storing the roll of stamps 18. The hollow storage compartment 15 is provided with a stamp inlet 16 and a stamp outlet 17 for inserting the roll of stamps 18 into and dispensing each stamp 19, one by one, from the hollow storage compartment 15 through the stamp outlet 17 and a stamp inlet 16, respectively.

Figure 3:
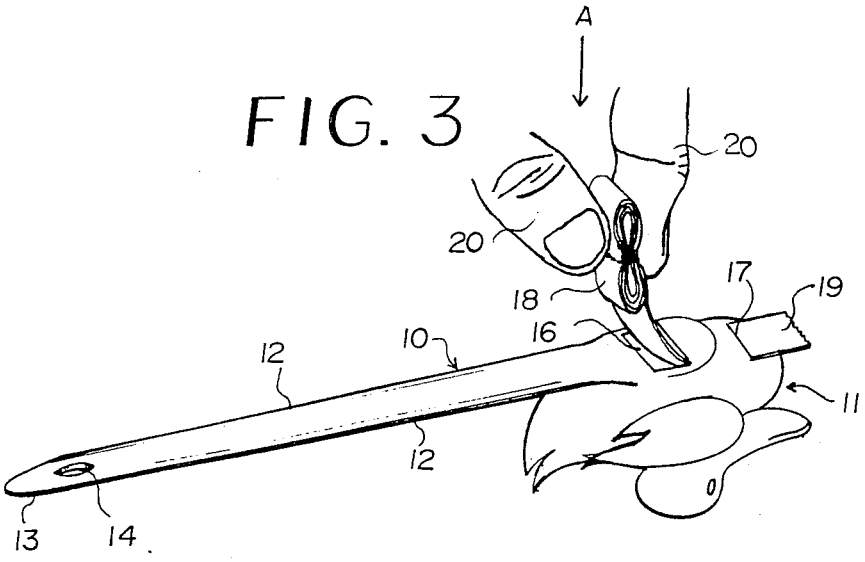
FIG. 3 is a perspective view of the reverse of FIG. 1 showing the operation for inserting a roll of stamps into a stamp dispenser disposed in a handle according to the present invention.

According to the present invention, the stationery device operates as follows:

As shown in FIG. 3, after inserting the first end stamp 19 into the stamp inlet 16 and, in sequence, inserting the first end stamp 19 into the stamp outlet 17, the roll of stamps 18 is squeezed and, in sequence, the squeezed roll of stamps 18 is inserted into the hollow storage compartment 15 by the fingers 20 through the stamp inlet 16 in the direction indicated by arrow (A) as shown in FIG. 3. Thereafter, if necessary, the opener can be hung on an engagement such as a nail through the aperture 14.

A sealed envelope or paper (not shown) to be cut can be readily cut by using the pointed end 13 and consequently cut by using both of the blades 12. Also, the envelope opener body 10 can be used as a ruler for measuring inches 21 and centimeters 22. Since the animal configurated handle 11 has a rugged surface, it is believed that the user can efficiently grasp the handle 11 by the hand while handling the opener of the present invention.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An envelope opener which comprises:

an envelope opener body having paper cutting blades disposed along the edges thereof, said envelope opener including:

a front blade and a rear blade disposed along both edges thereof, said front blade having demarkated thereon a measuring scale in inches and rear blade having demarkated thereon a measuring scale in the metric system, a pointed end disposed at a first end portion of said envelope opener body, and an aperture in the vicinity of said pointed end for receiving an engagement therethrough so that the envelope opener may be hung, and a handle member having an animal configuration, said handle member including:

a hollow storage compartment formed therein for storing a roll of stamps, an inlet for inserting the roll of stamps into said hollow storage compartment, and an outlet for dispensing a stamp, one by one, from said hollow storage compartment, whereby, after the roll of stamps is inserted into the hollow storage compartment through the inlet, the envelope opener may be used to easily open a sealed envelope and also the stamps may be conveniently dispensed one by one through the outlet.

2. The envelope opener of claim 1, wherein the animal configuration is a mammal or a bird.

3. The envelope opener of claim 1, wherein the metric system is centimeters.

* * * * *